United States Patent [19]

Brohard

[11] 4,112,279

[45] Sep. 5, 1978

[54] PIEZOELECTRIC RELAY CONSTRUCTION

[75] Inventor: Ivan Eugene Brohard, Westerville, Ohio

[73] Assignee: Bell Telephone Laboratories, Incorporated, Murray Hill, N.J.

[21] Appl. No.: 830,154

[22] Filed: Sep. 2, 1977

[51] Int. Cl.[2] ..... H01H 57/00

[52] U.S. Cl. ..... 200/181; 310/332; 310/367; 361/211

[58] Field of Search ..... 200/23, 181; 361/211; 310/332, 367

[56] References Cited

U.S. PATENT DOCUMENTS

| | | | |
|---|---|---|---|
| 2,800,551 | 7/1957 | Crownover | 200/181 |
| 3,745,385 | 7/1973 | Nakajima et al. | 310/367 X |
| 3,777,093 | 12/1973 | Sterns et al. | 200/181 |
| 3,949,247 | 4/1976 | Fenner et al. | 310/332 |

FOREIGN PATENT DOCUMENTS

| | | | |
|---|---|---|---|
| 1,095,042 | 12/1967 | United Kingdom | 200/181 |

OTHER PUBLICATIONS

NASA Tech. Brief, Goddard Space Flight Center, B74-10089, "Piezoelectric Relay," Aug. 1974, 2 pages.

*Primary Examiner*—Robert S. Ward, Jr.
*Attorney, Agent, or Firm*—William H. Kamstra

[57] ABSTRACT

A piezoelectric relay construction in which the active element comprises a bimorph sheet having a substantially "U" shaped perforation therethrough to present an armature section having a free end deflectable within the boundaries of the sheet and a frame section for the armature section. A first contact is mounted on the free end of the armature section and a second contact is mounted in opposition to and spaced apart from the first contact on a conductive clip affixed to the frame section. Remanent polarizations are induced in the piezoelectric layers of the bimorph sheet which are in opposition in the armature section and the frame section of the sheet. Suitable terminals on the frame section interconnected with circuit means including the electrode surfaces of the bimorph sheet are provided for the application of operating voltages. Similarly, additional terminals on the frame section and other circuit means including the contacts and conductive clip provide means for connecting the relay in external circuitry to be controlled.

13 Claims, 4 Drawing Figures

PIEZOELECTRIC RELAY CONSTRUCTION

BACKGROUND OF THE INVENTION

This invention relates to electromechanical relays and more particularly to such relays employing piezoelectric laminates as active elements.

Piezoelectric relays have in recent years shown promise as alternatives for relays operated electromagnetically. In addition to not requiring windings and cores, such relays offer a number of other advantages among which may be mentioned their low power consumption and heat generation, reduced physical size, relatively simple component parts, and, importantly, their potential for batch fabrication by printed wiring techniques. Further, the voltages required for their operation are sufficiently low to permit integrated circuit control.

Typically, the switch element of a relay operated by piezoelectric or electrorestrictive effect comprises a laminate formed of two layers of piezoelectric ceramic material each having an electrode coating fired to each side. The two coated sheets are cemented to opposite sides of a separating conductive centervane which centervane, in one mode of operation, also constitutes one electrode of the relay. In a well-known fabrication step, the piezoelectric material of each layer has a remanant polarization induced therein by applied D.C. electric fields. For the parallel mode of operation contemplated, the layers are polarized in the same direction. In one prior art arrangement, the piezoelectric laminate is mounted at one end on a base member and spaced therefrom by a spacer block. A bracket also mounted on the base member at its other end carries a contact spaced apart from and in alignment with a contact carried at the free end of the laminate. Flexure of the laminate to close the contacts is accomplished in the parallel mode by connecting and grounding the outer electrode coatings of the two layers and applying an operating voltage to the centervane. As a result, electrostatic fields are created in the layers which in one layer agree with the direction of polarization and in the other layer oppose that direction. In accordance with electrostrictive phenomenon of piezoelectric materials, one layer expands lengthwise while the other layer contracts. The resulting stresses cause the laminate to bend; for the cantilever laminate here envisioned, the bending motion is perpendicular to the planes of the laminate electrode coatings thereby causing the contacts to close. Removal of the operating voltage restores the contacts as a result of the restoring mechanical effect of the remanent polarization of the piezoelectric layers.

Although piezoelectric relays have proved themselves in many applications, their manufacture has been attended by a number of problems. Thus, for example, the forces and deflections attainable by electrostrictive effect are relatively small with the result that manufacturing and assembly tolerances may frequently be critical. Further, the difficulty of achieving flat piezoelectric laminates, or bimorphs as they are frequently termed, that is, laminates of uniform surface contours, presents the problem of obtaining consistent contact separation and closure force. A more efficient utilization of the electrostrictive effect as well as less stringent requirements for contact gap control during fabrication, would thus simplify the manufacture of piezoelectric relays and thereby enhance their attractiveness as circuit control elements and it is with these considerations that this invention is chiefly concerned.

It is accordingly an object of this invention to improve the efficiency of piezoelectric relays.

Another object of this invention is to simplify the manufacture of piezoelectric relays.

Also an object of this invention is to relieve manufacturing margins and tolerances in the manufacture and assembly of piezoelectric relays.

A further object of this invention is to provide an improved piezoelectric relay construction which readily lends itself to automatic assembly.

SUMMARY OF THE INVENTION

The foregoing and other objects of this invention are realized in one specific illustrative embodiment thereof comprising a laminate or bimorph formed, in accordance with the prior art, of two sheets or layers of piezoelectric ceramic material each having a coated electrode surface fired on each side. The two sheets are cemented to opposite sides of an electrically conductive centervane. The rectangular bimorph thus formed is separated into two distinct operative sections by a "U" shaped cut to present what may be termed an armature suspended from an enclosing frame section by a hinge section at the open end of the "U". The frame section below the free end of the armature constitutes the base of the relay structure so far described. Before lamination of the bimorph layers, the frame sections of the layers are polarized in the same directions as viewed from their ultimate positions relative to the centervane. The armature sections of each layer are also similarly polarized but in the opposite directions from those of the frame sections.

On one side of bimorph sheet, the free end of the suspended armature has mounted thereon an electrical contact connected by conductor means to a first circuit terminal affixed to and extending from the bimorph sheet at its base. A mounting for an opposing, second electrical contact is clipped about an edge of the bimorph sheet base to extend opposite the first contact, which mounting is electrically connected to a second circuit terminal. To operate the relay, a suitably poled operating voltage is applied across two additional terminals extending from the bimorph sheet base, one electrically connected to both outer-coated electrode surfaces of the sheet and one connected to the centervane. In this parallel mode of operation, the electrostatic fields generated between the centervane and outer electrodes agree with the polarization of the suspended armature of the first layer and the frame section of the second layer and oppose the polarization of the suspended armature of the second layer and the frame section of the first layer. As a result, the frame section of the bimorph sheet is caused to flex in a direction away from the contacts. The slight curvature thus induced in the frame section at the armature hinge, even without further electrostrictive action, causes an angular movement of the armature in a manner to bring its mounted contact into partial closure with the opposing clip mounted contact. The suspended armature, however, is also stressed by the operating voltage to add its own opposite curvature to the closure travel of its contact.

It is thus one feature of a piezoelectric relay construction according to this invention that in a single bimorph sheet, two independently generated electrostrictive forces augment each other so that the moveable contact can be moved a distance approximately twice that of the movement hitherto available in a single bimorph element relay. Advantageously, assuming a normal contact gap, positive contact closure is thus ensured and with a force which is also approximately twice that hitherto attainable in a single bimorph element relay.

According to another feature of a relay according to this invention, the clip mounting of the fixed contact permits a ready adjustment of the gap after assembly. Notwithstanding surface deformities in the bimorph sheet, the proximity of the fixed contact to the armature carried contact may be adjusted simply by suitably bending its mounting clip.

The single bimorph sheet relay briefly considered in the foregoing is complete and fully operative as described. Typically, a suitable mounting for the sheet base as well as a protective envelope will normally be provided. In this connection, the very small cross-sectional dimensions of the relay including, as it does, only a single bimorph sheet, advantageously lends itself to multiple installation in a single container. The elimination of spacer blocks and individual base support elements heretofore required permits a very close packing of individual relays.

The principles of this invention as considered in the foregoing may be extended to realize a further relay embodiment comprising a multicontact arrangement also on a single bimorph sheet. In this arrangement, a plurality of "U" shaped cuts in one extended sheet achieve a number of the piezoelectric relays as described hereinbefore, each individually operable by respective operating voltages.

BRIEF DESCRIPTION OF THE DRAWING

The foregoing and other objects and features of this invention will be better understood from a consideration of the detailed description of the organization and operation of one specific illustrative embodiment thereof which follows when taken in conjunction with the accompanying drawing in which.

DETAILED DESCRIPTION

Figure 1:
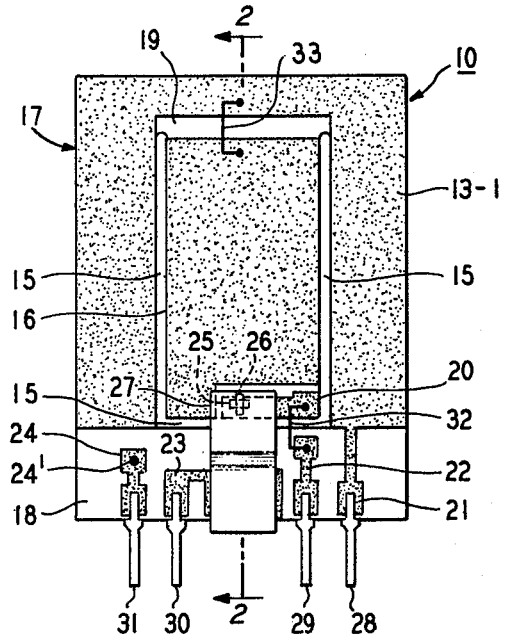
FIG. 1 is a frontal view of a piezoelectric relay construction according to this invention.
Figure 2:
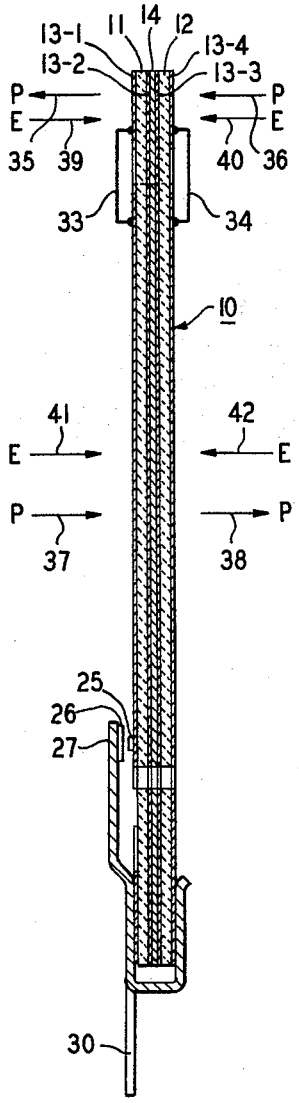
FIG. 2 is an enlarged cross-sectional view of the relay construction of FIG. 1 taken along the line 2–2.

One illustrative piezoelectric relay arrangement according to this invention is shown in front and sectional side views in FIGS. 1 and 2 as sharing with prior art piezoelectric devices a piezoelectric laminate or bimorph sheet 10. The manner of fabrication of the stock for sheet 10 is well-known in the art and need only be briefly considered. As shown in FIG. 2, sheet 10 comprises a pair of piezoelectric layers 11 and 12 each having an electrode surface coated on its opposite sides. One electrode surface 13-1 of layer 11 is shown in FIG. 1, the contours of which will be described in greater detail hereinafter. The layers 11 and 12 may be formed of any suitable piezoelectric ceramic material such as the lead zirconate-lead titanate PZT-5B material available in the past from the Piezoelectric Division of Vernitron Corporation. The electrode surfaces may each conventionally comprise a silver coating. The layers 11 and 12 are cemented to opposite sides of a brass centervane 14 to complete the laminate structure. In accordance with this invention and as shown in FIG. 1, bimorph sheet 10 has a substantially "U" shaped cut 15 therethrough to divide bimorph sheet 10 into what may be termed an armature 16 suspended from a frame section 17, the open end of the "U" forming a hinge section of the bimorph sheet for armature 16. Electrode surface 13-1 and corresponding outer electrode surface 13-4 are not continuous over the outer sides of piezoelectric layers 11 and 12 but rather are selectively coated to present specific conducting areas. Thus, frame section 17 has an electrode surface coated thereon only down to the base of the "U" shaped cut to provide a non-conducting base 18 for bimorph sheet 10. Electrode surface 13-1 of frame section 17 is electrically isolated from the electrode surface of armature 16 by a horizontal void 19 at the hinge section of sheet 10. The electrode surface of layer 11 armature 16 is interrupted near its free end to provide an electrically isolated conducting path 20 from one of its edges to a central point. At the base 18 surface of layer 11, the electrode surface of frame section 17 is extended to present a second conducting path 21 extending therefrom to the lower edge of base 18. A similar conducting path 22 formed by an electrode surface also extends from the latter edge of base 18 to near the base of the "U" shaped cut. The conducting paths 21 and 22 provide connecting areas for terminals of the relay to be described. A further conducting path 23 formed by an isolated electrode surface provides a further area for electrical connections. A final isolated electrode surface on the base 18 of layer 11 provides a conducting path 24 and another electrical connecting area.

The corresponding outer side of layer 12 visible only in the side view of FIG. 2 is similarly selectively coated with an electrode surface 13-4 with the exception that an isolated conducting path 20 need not be provided. The outer electrode surface 13-4 of layer 12 visible only in FIG. 2 thus has an electrode surface extension to the edge of base 18 to form a conducting path directly opposite path 21 of layer 11. Similarly, an isolated electrode surface on layer 11 provides a conducting path identical to and directly opposite path 24 of layer 11. The entire inner sides of layers 11 and 12 facing centervane 14 are coated with electrode surfaces 13-2 and 13-3 again visible only in cross-section in FIG. 2. The organization of a relay construction according to this invention is completed by the provision of suitable electrical interconnection elements. In accordance with the unitary character of the relay, each of the interconnection elements are affixed to the bimorph active element itself. A moveable contact 25 is mounted on the free end of armature 16 on the electrode surface conductor 20 at substantially the midpoint of armature 16. A fixed contact 26 is mounted directly opposite and spaced apart from contact 25 on a mounting clip 27. Clip 27 is adapted to fit about bimorph sheet 10 at its base 18 and to make suitable electrical connection with electrode surface conductor area 23 by soldering, for example. Extending from base 18 are a number of terminals for making connection to an operating voltage source and to the circuit, the continuity of which is to be controlled by the relay. A first terminal 28 provides by means of a bifurcated yoke an electrical connection both with conducting path 21 on layer 11 and its directly opposite counterpart conducting path on layer 12. A second terminal 29 makes a similar connection with electrode surface conducting path 22 and may also be clipped about base 18 but without making electrical connection with electrode surface 13-4. A terminal 30 is also provided to make the same electrical connection with electrode surface conducting area 23 and may again be clipped about base 18 without making electrical connection with the rear electrode surface 13-4. A final terminal 31 makes electrical connection with surface conducting path 24 and, by means of a bifurcated yoke, with its directly opposite counterpart conducting path on layer 12. Terminal 24 is electrically isolated from layers 11 and 12 and makes electrical connection only with inner centervane 14 by means of a plated through via hole 24'. Terminals 28 through 31 may also be suitably affixed to their respective conducting areas by soldering. Electrical connections are also made between conducting paths 20 and 22 and between the electrode surface areas of frame section 17 and armature 16 on layer 11 by conductors 32 and 33, respectively. A counterpart to the latter, conductor 34 (FIG. 2), makes an electrical connection between the corresponding electrode surface areas on layer 12.

The foregoing terminals and interconnections provide operating circuit means for the relay of this invention as follows. Terminals 28 and 32 provide means for applying an operating voltage between centervane 14 and each of the electrode surfaces 13-1 and 13-4 of piezoelectric layers 11 and 12, respectively. In the parallel mode of operation contemplated for the operation of the relay being described, a positive voltage is thus simultaneously applied to electrode surfaces 13-1 and 13-4 by means of terminal 28 which is electrically connected to both surfaces as mentioned. The positive voltage is applied to the entire electrode surfaces of the two sides including those of armature 16 via conductors 33 and 34. At the same time terminal 31, connected only to centervane 14, provides a means for negatively charging or grounding the latter element during operation of the relay. Terminals 29 and 30 are adapted for serial connection in the circuit, the continuity of which is to be controlled by the relay of this invention, the relay control portion of which may be traced as follows: terminal 29, conducting path 22, bridge conductor 32, electrode surface area 20, contact 25, contact 26, mounting clip 27, electrode surface area 23, and terminal 30.

Figure 3:
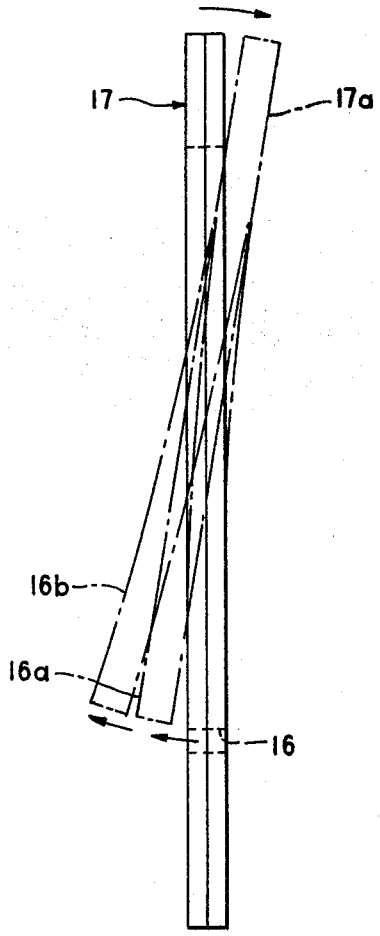
FIG. 3 is a side and simplified view of the bimorph sheet portion of the relay of FIG. 2 showing in steps the double-acting movement of the bimorph armature during the operation of a relay according to this invention.

With the foregoing organization of a specific piezoelectric relay construction according to this invention in mind, an illustrative operation thereof may now be described with particular reference to FIG. 3. Before proceeding to such an operation, a further and well-known step in the fabrication of piezoelectric relay devices will be briefly considered. Before lamination, each of the piezoelectric layers 11 and 12 is suitably polarized. That is, D.C. electric fields are applied to the layers to create domains with favorably oriented dipoles thereby inducing remanent polarizations in the layers which may be analogized to remanent magnetizations in ferromagnetic materials. This polarization step may be carried out with fields in the order of 600 volts applied under suitable temperature conditions and over appropriate time intervals, as is known. In accordance with the principles of this invention and differing from prior art piezoelectric devices, each layer 11 and 12 has oppositely directed polarizations within each layer. Thus, the frame sections 17 of each layer are similarly polarized in the directions as indicated by arrows 35 and 36 (FIG. 2). The armature sections 16 of each layer on the other hand are polarized in the opposite directions as indicated by arrows 37 and 38. The inducement of these oppositely directed polarizations during fabrication is facilitated by leaving electrode surface voids 19 on the outer surfaces of layers 11 and 12 which voids are subsequently bridged by conductors 33 and 34.

The relay of FIGS. 1 and 2 is operated by applying an operating voltage across terminals 28 and 31, of a magnitude substantially less than that of the polarization voltage. The polarities of the operating voltages at various points of the layers are indicated by arrows 39 through 42. As a result and in accordance with piezoelectric phenomenon, an expansion occurs in the layers 11 and 12 where the operating voltage is in a depolarization direction and a contraction occurs where it is in the polarization direction. The result of the stresses thus generated in layers 11 and 12 may be seen in the exaggerated movements depicted in FIG. 3. In this enlarged view, only a side view of the laminated bimorph is shown and only the frame section 17 and armature 16 are indicated. Considering separately the effects on the latter sections of the stresses in layers 11 and 12 thus produced, frame section 17 will be caused to deflect slightly counter clockwise from base portion 18 to produce a slight curvature along its entire length, particularly as indicated in broken line outline at **17*a*, that is, at the hinge portion of armature 16. Without further stresses on armature 16, the surfaces of the latter member will extend tangentially from the inner and outer curvatures of frame section 17*a*, thereby swinging armature 16 also clockwise from its hinge portion as indicated at 16*a*. Advantageously, the movement of frame section 17 alone accordingly moves contact 25 part of the distance towards its opposing contact 26 (FIG. 2). Armature 16, however, also has piezoelectric stresses induced therein by operating voltages applied via conductors 33 and 34. These stresses, opposite in direction to those induced in frame section 17 of sheet 10, cause a slight clockwise curvature in armature 16 thereby moving its contact 25 as indicated at 16*b* the remaining distance into engagement with opposing contact 26. Two forces thus advantageously are additive to bring contacts 25 and 26 into engagement. As a result, assuming a normal contact gap, the distance each force is required to move the moveable contact is substantially halved. Since the required movement of the two sections of bimorph sheet 10 is reduced, the magnitude of the operating voltage may be correspondingly reduced. Upon the termination of the applied operating voltage, the hysteretic characteristic of the remanent polarizations of frame section 17 and armature 16** restores the relay to its normal unoperated state.

Figure 4:
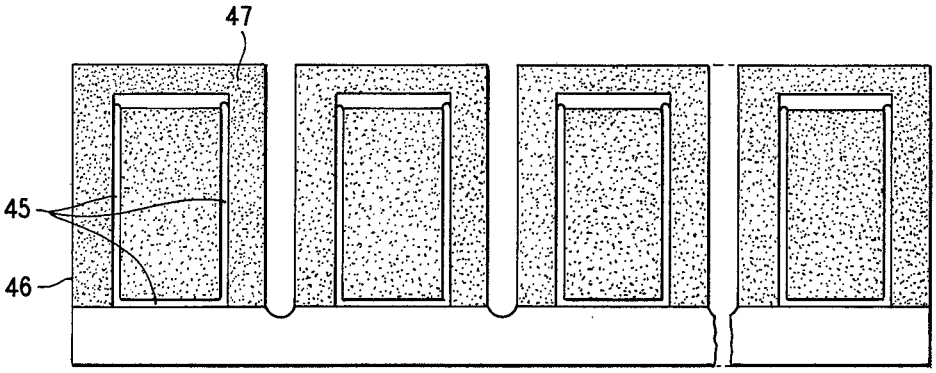
FIG. 4 depicts a multicontact embodiment of a bimorph element of a piezoelectric relay according to this invention.

In FIG. 4 is shown the manner in which the principles of this invention may be extended to realize a multi-contact relay arrangement. Since each contact section is identical to that described in the foregoing, only the bimorph element is depicted in the figure. A plurality of side-by-side "U" shaped cuts 45 are made in a single bimorph sheet 46. The areas of sheet 46 defining individual relay sections have individual electrode surfaces 47 fired thereon for independent operation of each as described in the foregoing.

In practice, each embodiment of a relay arrangement according to this invention is contemplated as being affixed by its base to a suitable insulated support means and conventionally enclosed by a protective container as is known in the art. It will also be appreciated that, although the parallel mode of operation was assumed for the embodiment of the invention described, it could as well have been operated in the known series mode. In this mode of operation, an operating voltage would be applied only to the electrode surfaces 13-1 and 13-4 and not to centervane 14. The construction of the relay in this case would be modified only to the extent of connecting terminal 28 via conducting path 21 only to electrode surface 13-1 and disconnecting terminal 28 from the opposite electrode surface 13-4. A connection from the latter electrode surface is then made to terminal 31 which may conveniently be accomplished by means of a bridging conductor such as conductor 32, terminal 31 being disconnected from centervane 14. Regardless of the mode of operation, it will be appreciated that a relay construction according to this invention achieves a smaller, more compact and simpler structure than heretofore possible. Contact gap adjustment is also readily accomplished notwithstanding variations in the planes of the bimorph sheets. The clip mounting of the fixed contact permits such adjustment by simply bending clip 27 as required to close or open the contact gap.

What have thus been described are considered to be only specific illustrative piezoelectric relay constructions according to the principles of this invention and it is to be understood that various and numerous other arrangements may be devised by one skilled in the art without departing from the spirit and scope of the invention as defined by the accompanying claims.

What is claimed is:

1. A piezoelectric switch device comprising a bimorph sheet comprising layers of material exhibiting piezoelectric properties, each having electrodes comprising metallic surface coatings thereon, and an electrode comprising a conductive centervane, said sheet having a substantially "U" shaped perforation therethrough to present an armature member having a moveable free end within the boundaries of said sheet, a first electrical contact mounted on said free end of said armature member, a conductive clip member mounted on said sheet, and a second electrical contact mounted on said clip member in opposition to and spaced apart from said first contact.

2. A switch device as claimed in claim 1 in which said layers each has particular remanent polarizations induced thereon, the polarizations of the layers of said armature member being in directions opposite to the directions of polarizations of the layers of the remainder of said sheet.

3. A switch device as claimed in claim 1 also comprising a first and second terminal affixed to said sheet, first circuit means connecting said first terminal and said first contact, and second circuit means connecting said second terminal and said clip member.

4. A switch device as claimed in claim 3 also comprising a third and fourth terminal affixed to said sheet, and circuit means for interconnected said third and fourth terminal and particular electrodes of said sheet.

5. A switch device as claimed in claim 4 in which said circuit means comprises means for connecting said third terminal to one electrode of each of said layers and for connecting said fourth terminal to said centervane.

6. A piezoelectric relay construction comprising a bimorph sheet comprising a conductive planar centervane, a first and a second layer of a material exhibiting piezoelectric properties affixed to opposite sides of said centervane, and a first and a second electrode comprising a metallic coating on the outer surfaces of said first and second layer, respectively, said sheet having a substantially "U" shaped perforation therethrough to present an armature section having a moveable free end within the boundaries of said sheet and a frame section for said armature section, said first and second layer of said frame section having remanent polarizations induced therein, a first electrical contact mounted on on said free end of said armature section, a conductive clip member mounted on said sheet, a second electrical contact mounted on said clip member in opposition to and spaced apart from said first contact, first circuit means including a first pair of terminals and said first and second electrodes on said frame section for applying an operating voltage across said layers of said frame section, and second circuit means including a second pair of terminals, said first and second contact, and said clip member.

7. A piezoelectric relay construction as claimed in claim 6 in which said first and second layer of said armature section having remanent polarizations induced therein of a direction opposite to the direction of said remanent polarizations of said first and second layer of said frame section of said sheet, and in which said first circuit means also includes said first and second electrodes on said armature section of said sheet.

8. An electrical relay construction comprising a bimorph sheet comprising a conductive planar centervane, a first and a second layer of a material exhibiting piezoelectric properties affixed to opposite sides of said centervane, and first and second electrode means for the outer surfaces of said first and second layer, respectively, said sheet having a substantially "U" shaped perforation therethrough to present an armature section having a moveable free end within the boundaries of said sheet and a frame section for said armature section, said first and second layer of said frame section having remanent polarizations of a first direction induced therein, said first and second layer of said armature section having remanent polarizations induced therein of a second direction opposite to said first direction, a first electrical contact mounted on said free end of said armature section, a conductive clip member mounted on said frame section of said sheet, and a second electrical contact mounted on said clip member in opposition to and spaced apart from said first contact.

9. An electrical relay construction as claimed in claim 8 also comprising first circuit means including said first and second electrode for applying activating voltages to said first and second layer.

10. An electrical relay construction as claimed in claim 9 also comprising second circuit means on said armature section and said frame section including said first and second electrical contact.

11. An electrical relay construction as claimed in claim 10 in which said first and second electrode means each comprises a metallic coating affixed to an outer surface of said first and second layer.

12. An electrical relay construction having a piezoelectric bimorph sheet as an active element for contact closure responsive to applied operating voltages CHARACTERIZED IN THAT said sheet has a substantially "U" shaped perforation therethrough to present an armature section having a moveable free end within the boundaries of said sheet and a frame section for said armature section, a first contact is mounted on said free end of said armature section and a second contact is mounted in opposition to and spaced apart from said first contact on a conductive clip affixed to said frame section.

13. An active element for piezoelectric devices comprising a bimorph sheet having a substantially "U" shaped perforation therethrough to present a first member deflectable within the boundaries of said sheet and a deflectable second member comprising a frame section for said first member.

* * * * *